US005421041A

United States Patent [19]

Stern

[11] Patent Number: 5,421,041

[45] Date of Patent: Jun. 6, 1995

[54] POOL COPING PROTECTOR

[76] Inventor: Robert Stern, 1746 Lakewood Rd., Toms River, N.J. 08753

[21] Appl. No.: 105,723

[22] Filed: Aug. 12, 1993

[51] Int. Cl.[6] ..... E04H 4/14

[52] U.S. Cl. ..... 4/498; 52/3; 24/563

[58] Field of Search ..... 4/496, 498, 499, 503, 4/510, 512; 52/3; 150/154; 224/42.39, 42.4; 24/563, 545, 339

[56] References Cited

U.S. PATENT DOCUMENTS

| | | | |
|---|---|---|---|
| D. 30,501 | 4/1899 | Wright | 24/563 |
| 1,884,135 | 10/1932 | Nett et al. . | |
| 2,751,653 | 6/1956 | Leibow | 24/563 X |
| 2,870,454 | 1/1959 | Schippert et al. | 4/503 |
| 2,908,522 | 10/1959 | Glave | 224/42.4 |
| 4,905,431 | 3/1990 | Davis | 52/179 |
| 4,916,763 | 4/1990 | Christensen | 4/503 |
| 5,014,369 | 5/1991 | Daus | 4/503 |
| 5,134,730 | 8/1992 | Vandis | 4/496 |

*Primary Examiner*—Carl D. Friedman
*Assistant Examiner*—Laura A. Saladino
*Attorney, Agent, or Firm*—Clifford G. Frayne

[57] ABSTRACT

A pool deck protector cooperative with the perimeter coping of the pool to prevent wear and discoloration to the pool deck and pool coping by the tie-down assembly securing the pool cover to a pool cover anchor. The pool deck protector is generally planar with one edge curved under upon the underside of the planar member, the curved edge having a decreasing radius such that it is frictionally engageable in a snap-fit manner with the perimeter coping of the pool to position the pool deck protector in alignment with the tie-down assembly thereby protecting the perimeter coping and immediate pool deck area.

5 Claims, 3 Drawing Sheets

POOL COPING PROTECTOR

BACKGROUND OF THE INVENTION

1. Field of Invention

The present invention relates to a pool deck protector to prevent the wear and tear and disfigurement of the pool deck and pool coping, and more particularly, to a pool coping protector which is cooperative with the pool cover and pool tie down system to prevent damage to the coping surrounding the edge of the pool.

2. Description of the Prior Art

The use of a pool cover to overlay the surface of a swimming pool which is either full or partially full of water is of widespread use. A factor for the use of a swimming pool cover is for safety concerns regarding small children. The other reason for use is to prevent the entry of leaves, debris or dirt when the pool is not in use. This use is particularly widespread in climatic zones in which the pool is not used year round, but rather seasonally, and structural requirements or economics require that the pool remain full during the off season.

Typically, the pool cover is manufactured to conform to the perimeter outline of the pool and is secured by anchors in the form of anchor bolts secured to the pool deck about the perimeter of the pool, positioned several feet outwardly from the edge of the pool.

A typical anchoring system for a pool cover may be found in U. S. Pat. No. 4,916,763 to Christiansen. The anchoring system disclosed by Christiansen is representative of the type utilized in the pool industry. Christiansen in the aforesaid patent attempted to solve the problem of discoloration or disfiguration of the decking material by the tension spring through the use of a protective strip on the underside of the tensioning spring. Similarly, U. S. Pat. No. 5,014,369 to Daus, discloses an alternative form of pool cover tie down system to prevent discoloration or disfigurement of the pool deck by means of flexible, rubber-like tie downs which secure the pool cover to the anchor bolt.

Both of the systems disclosed in the aforesaid patents attempt to prevent discoloration, disfigurement or disfigurement of the pool deck in the area proximate to the anchor bolt. However, in various pool tie down configurations, the pool cover and securing strap, when installed, are proximate to the coping of the swimming pool, the coping being the perimeter edge of the pool which extends outwardly from the pool edge approximately 6 to 10 inches. This point of contact between the securing strap and the pool cover oftentimes causes discoloration, wear, or disfigurement to the coping of the pool itself. This is accomplished by slight movement of the pool cover and attendant securing straps by wind or other weather elements causing the pool cover and attendant securing straps to move or vibrate, the securing straps vibrating in a very narrow range while in frictional contact with the coping of the pool, thus causing the discoloration or wear and tear and disfigurement.

Applicant's invention represents a simplified add-on feature which is cooperative with the coping or alternatively, cooperative with the coping and the tie-down strap to provide a protective surface to the coping during the term in which the pool cover is in use. Applicant's invention is inexpensive and capable of being utilized with pool covers and pool tie-down systems already in use or designed to cooperate with pool covers and tie-down systems which a pool owner may utilize in the future.

OBJECTS OF THE INVENTION

An object of the present invention is to provide for a novel protective pool coping cover which is frictionally engageable and cooperative with the coping of a swimming pool in order to protect the coping and pool deck from wear or discoloration from the pool cover tie-down assembly.

A still further object of the present invention is to provide for a novel pool coping protector for use with a myriad of pool cover tie-down assemblies.

A still further object of the present invention is to provide for a protective pool coping member which is engageable with the coping of the pool and also with the pool cover tie-down assembly in order to prevent wear and discoloration to the coping and the pool deck.

SUMMARY OF THE INVENTION

A pool deck protector being generally rectangular and planar in shape having one edge curved under, the arc of which is in a decreasing radius, this curved edge designed to frictionally engage the coping of the pool, thereby positioning the planar rectangular portion over the planar portion of the coping and/or pool deck, the pool deck protector being positioned on the coping at a position where the pool cover tie-down assembly would extend over it, between the pool cover and the anchor bolt for the pool tie-down assembly.

BRIEF DESCRIPTION OF THE DRAWINGS

A better understanding of the present invention will become more apparent from the following description, particularly when taken in conjunction with the accompanying drawings wherein.

DETAILED DESCRIPTION OF THE DRAWINGS

Figure 1:
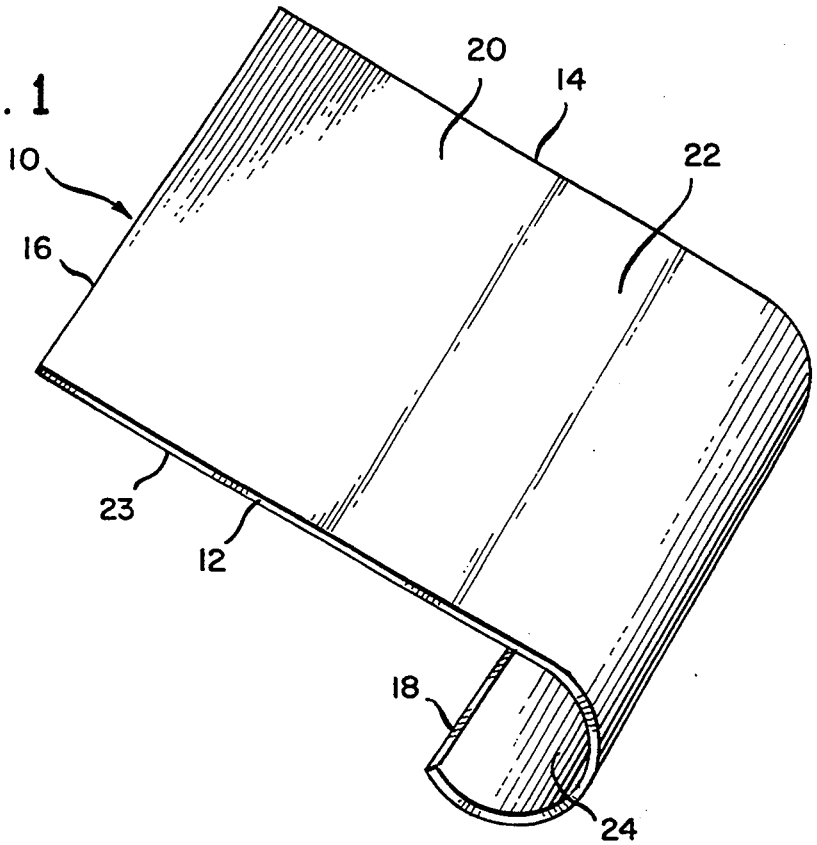
FIG. 1 is a perspective view of the pool deck protector.

FIG. 1 is a perspective view of the pool deck protector 10 having longitudinal edges 12 and 14 and lateral edges 16 and 18. Pool deck protector 10 is one-piece molded or extruded construction, preferably of plastic or another resilient, non-corrosive material.

Pool deck protector 10 is further defined by a generally planar, rectangular portion 20 having an upper surface 22 and a lower surface 23. Lateral edge 18 of pool deck protector 10 is curved or turned under to form a generally C-shaped channel portion 24. In this configuration, from a side or cross-sectional view along lateral edge 12, the pool deck protector 10 appears to be somewhat fishhook shaped as illustrated in FIG. 3.

Figure 3:
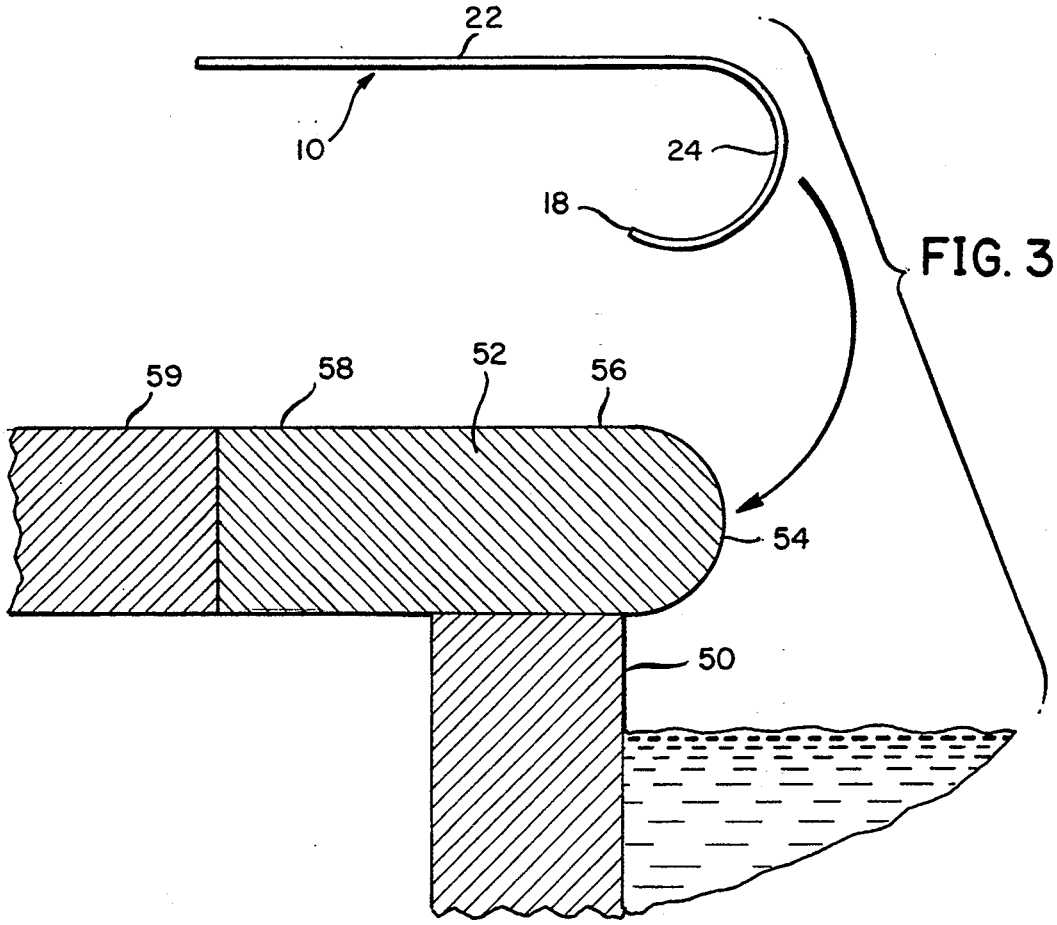
FIG. 3 is a partial, side, cross-sectional, exploded view of the pool deck protector in relationship to the pool deck, coping, and sidewall.

The radius of channel section 24 decreases from generally planar, rectangular portion 20 of pool deck protector 10 to lateral edge 18 as will best be described and appreciated with reference to discussions regarding FIG. 3.

Figure 2:
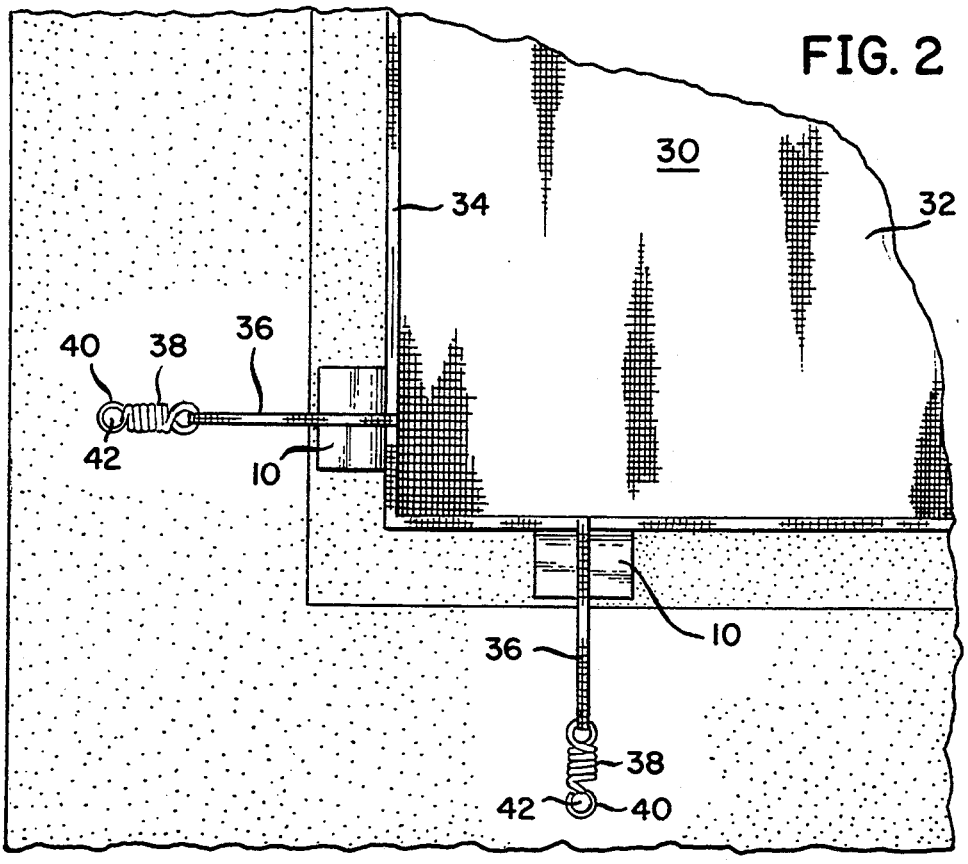
FIG. 2 is a partial top view of a swimming pool having a pool cover in position and showing the location of the pool deck protector which is the subject of this application.

FIG. 2 is a top, partial view of a portion of a swimming pool 30, having its pool cover 32 in position. Typically, pool cover 32 is of a vinyl or mesh-like material having reinforced seams 34 about its perimeter and perhaps also bisecting the pool cover at numerous locations depending upon its size. Extending outwardly from the reinforced seams 34 would be a plurality of tie-down straps 36. Tie-down straps 36 would be either sewn or otherwise securely fastened to the reinforced seam 34 of pool cover 32.

In a typical and popular tie-down arrangement currently in use, straps 36, which are adjustable, would be secured to a tension spring mechanism 38 which in turn would have an O ring or other suitable fastening device 40 which would cooperate with the anchor bolt 42 which normally would be set in the pool deck at intervals, surrounding the pool. In such a case, the pool cover 32 would be positioned and O ring 40 would be positioned over the various anchor bolts 42. Adjustable straps 36 would then be adjusted to take up any slack in order to pull the pool cover into rigid tension over the open portion of the pool area thus covering it. Tension springs 38 allow for and permit some give in the pool cover in order to accommodate weather conditions, such as wind.

Since the pool cover is subject to weather conditions, the tied-down straps 36 are subject to some movement and/or vibration during the course of the pool cover's use. While these straps are oftentimes made of canvas or other cloth-like material, they nevertheless, due to vibrations from wind conditions, rub on the coping of the pool and the pool deck causing wear or discoloration. FIG. 2 illustrates the positioning of two of Applicant's pool deck protectors with respect to the two tie-down assemblies illustrated. These pool deck protectors insulate the pool deck and the coping from the wear and tear and discoloration caused by the tie-down straps.

FIG. 3 is a partial, side, cross-sectional view of a pool deck, pool coping and sidewall, showing the cooperative nature of the pool deck protector 10 with the pool coping. A typical pool construction, be it a steel pool with liner or a concrete pool, will have a sidewall 50, which will define the perimeter of the pool, and the sidewall 50 will be capped with a coping piece 52 which normally presents a rounded, inwardly-facing protrusion portion 54 in order to eliminate sharp edges about the perimeter of the pool. The coping member 52 extends outwardly from the pool perimeter anywhere from 6 to 12 inches, and may have a slightly downward curve or depression on its upper surface 56. The outwardly-extending end 58 of the coping member normally abuts the pool deck 59 into which the anchor bolts 42 for cooperation with the tie-down assembly are embedded. FIG. 3 illustrates how pool deck protector 10 cooperates with the coping member to snap fit over the coping member and secure pool deck protector 10 in place so that the tie-down assembly can pass above it and the pool deck protector can prevent the tie-down assembly from contacting the coping member 52. The radius of channel 24 formed in pool deck protector 10 is of a decreasing nature from its joining point with generally planar portion 20 of pool deck protector 10 to lateral end 18. The nature of the decreasing radius allows channel 24 to accommodate the protruding portion 54 of coping 52 such that lateral end 18 of pool deck protector 10 frictionally engages the lower portion of protrusion 54 of coping 52 and the remainder of channel 24 accommodates the protrusion portion in a snap-fit manner.

This configuration allows the easy installation of the pool deck protector 10 and ensures that it will not be displaced during the term of its usage. Its configuration has been designed to accommodate all pool tie-down assemblies currently in use, and thus, it allows the pool owner with a perfectly usable pool cover and tie-down assembly to merely obtain the pool deck protector which is the subject matter of this application in order to enhance the protection which he has for his pool and for his deck and coping.

Figure 4:
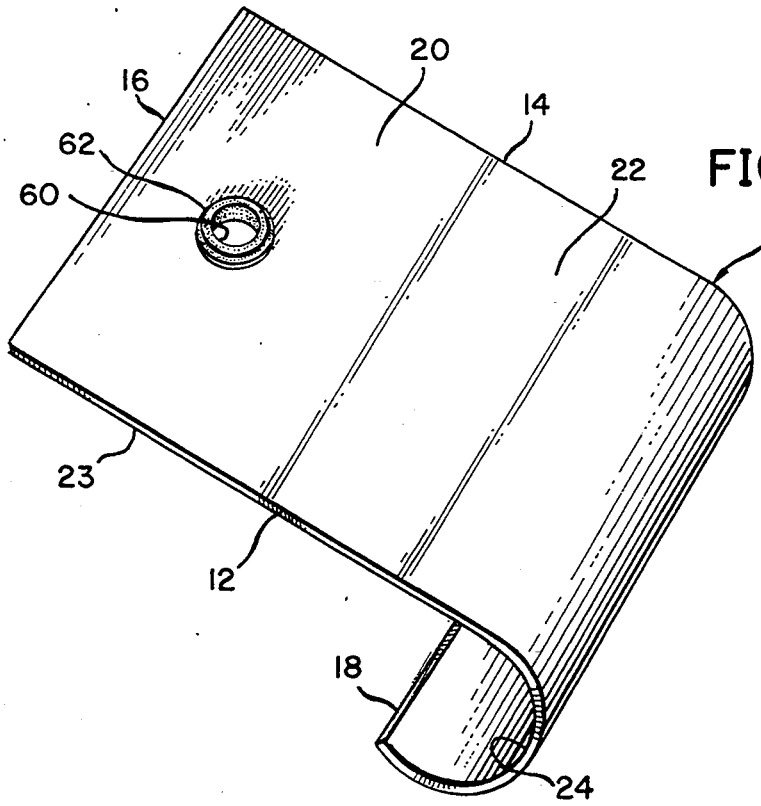
FIG. 4 is a perspective view of a second embodiment of the pool deck protector.
Figure 5:
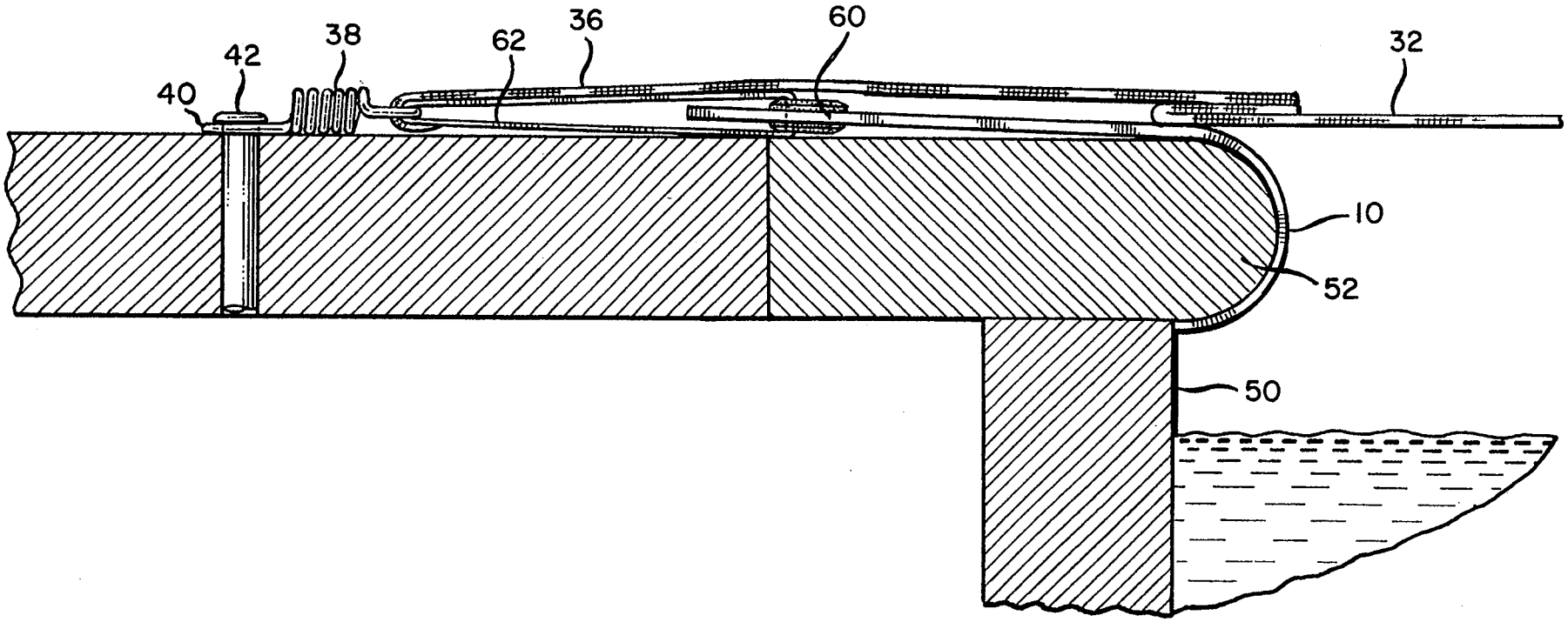
FIG. 5 is a partial, side, cross-sectional view of the second embodiment of the pool deck protector in cooperation with the pool coping and tie-down assembly of the pool cover.

FIGS. 4 and 5 illustrate a second embodiment of pool deck protector 10 which is identical to the first embodiment previously detailed, but the second embodiment, as illustrated in FIGS. 4 and 5, has an additional securing element which allows the pool deck protector 10 to not only be secured cooperative with the coping 52 of the pool, but also further allows the pool deck protector 10 to cooperate with the tie-down straps or the anchor means to further ensure its non-displacement during use.

FIG. 4 is a perspective view of the second embodiment of pool deck protector 10. It is identical to the first embodiment with the exception that in planar portion 20, there is centrally positioned an attachment means. In this embodiment, the attachment means comprises a reinforced grommet 62 defining an aperture 60 through planar portion 20. In this configuration, pool deck protector 10 is snap fit so as to frictionally engage coping 52. Aperture 60 allows a second attachment means to be secured to pool deck protector 10 and then be secured to the anchor means or to the pool cover tie-down, straps or spring mechanism 42, or 36 and 38, respectively. The attachment means could be by a suitable strap or bungee cord which is not abrasive to the pool coping or pool deck.

FIG. 5 illustrates a partial, side, cross-sectional view of the second embodiment in cooperation with pool cover 32, tie-down straps 36, tension spring 38 and anchor bolt 42. Pool deck protector 10 is frictionally engaged and snap fit over coping 52 and tie-down straps 36 rests upon the planar portion thereof which covers the coping. Tie-down straps 36 through tension spring 38 is secured to anchor bolt 42. A second tie-down strap 63 in the form of a bungee cord or the like is attached through aperture 60 in pool deck protector 10 and is similarly secured to the tie-down straps 36 or directly to tension spring 38 or in the alternative, to anchor bolt 42. This provides further assurance that pool deck protector 10 will remain in alignment with the tie-down assembly during the course of the pool cover's use.

While the present invention has been described in connection with the exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. In a pool cover arrangement comprising a pool having a perimeter coping, a pool cover complimentary with the perimeter coping, an anchoring means, and a tie-down assembly attaching said pool cover to said anchoring means, a pool deck protector comprising a generally planar, rectangular member having one edge curved under upon the underside of said planar member, said curved edge frictionally engageable with said perimeter coping maintaining said pool deck protector in alignment with said tie-down assembly and separating said tie-down assembly from said perimeter coping.

2. The pool deck protector in accordance with claim 1 wherein said one edge curved under upon the underside of said planar member has a decreasing radius from said planar member to said edge for frictional engagement with said perimeter coping.

3. The pool deck protector in accordance with claim 1 wherein said planar member of said pool deck protector has an attachment means formed therein, cooperative with a second tie-down assembly for securing said pool deck protector to said anchor means.

4. A pool deck protector in combination with a pool, a pool deck and a pool cover wherein said pool has a perimeter coping and said pool cover has at least one tie-down assembly secured at one end about the perimeter of said pool cover and secured to an anchor in said pool deck at an opposing end, said pool deck protector comprising a planar, rectangular member, one edge of said member curved under with a decreasing radius frictionally engaging said perimeter coping of said pool and in alignment with said at least one tie-down assembly of said pool cover separating said pool deck from said at least one tie-down assembly of said pool cover.

5. The pool deck protector in accordance with claim 4 wherein said planar member of said pool deck protector has an attachment means formed therein, cooperative with a second tie-down assembly for securing said pool deck protector to said anchor.

* * * * *